US011482175B2

(12) United States Patent
Sugiyama et al.

(10) Patent No.: US 11,482,175 B2
(45) Date of Patent: Oct. 25, 2022

(54) DEVICE AND METHOD FOR DRIVING A SELF-LUMINOUS DISPLAY PANEL

(71) Applicant: Synaptics Incorporated, San Jose, CA (US)

(72) Inventors: Akio Sugiyama, Tokyo (JP); Takashi Nose, Kanagawa (JP); Hirobumi Furihata, Tokyo (JP); Masao Orio, Tokyo (JP); Susumu Saito, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 17/459,860

(22) Filed: Aug. 27, 2021

(65) Prior Publication Data

US 2021/0390909 A1 Dec. 16, 2021

Related U.S. Application Data

(63) Continuation of application No. 16/810,497, filed on Mar. 5, 2020, now Pat. No. 11,132,952.

(30) Foreign Application Priority Data

Mar. 7, 2019 (JP) ..... 2019-041466

(51) Int. Cl.
*G09G 3/3258* (2016.01)
*G09G 3/20* (2006.01)

(52) U.S. Cl.
CPC ..... *G09G 3/3258* (2013.01); *G09G 3/2003* (2013.01); *G09G 2310/027* (2013.01); *G09G 2320/0626* (2013.01); *G09G 2320/0673* (2013.01)

(58) Field of Classification Search
CPC ..... G09G 3/3258; G09G 3/2003; G09G 2320/0276; G09G 2320/0285; G09G 2320/0295; G09G 2320/0626; G09G 2320/0673; G09G 2320/0686
See application file for complete search history.

(56) References Cited

U.S. PATENT DOCUMENTS

| | | | | |
|---|---|---|---|---|
| 9,398,246 | B2 | 7/2016 | Mori et al. | |
| 10,319,278 | B1 | 6/2019 | Nho et al. | |
| 10,424,255 | B2 * | 9/2019 | Pyo | G09G 3/3258 |
| 10,565,958 | B2 | 2/2020 | An et al. | |

* cited by examiner

*Primary Examiner* — Sardis F Azongha
(74) *Attorney, Agent, or Firm* — Ferguson Braswell Fraser Kubasta PC

(57) ABSTRACT

A display driver comprises gamma processing circuitry, compensation circuitry, and driver circuitry. The gamma processing circuitry is configured to process the image data to generate gamma processed image data. The compensation circuitry is configured to process the gamma-processed image data, based on a ratio of a number of display elements that emit light to a total number of display elements of a display panel, to generate compensated image data. The driver circuitry is configured to drive the display panel based on the compensated image data.

18 Claims, 13 Drawing Sheets

DEVICE AND METHOD FOR DRIVING A SELF-LUMINOUS DISPLAY PANEL

CROSS REFERENCE

This application is a continuation of and claims the benefit of priority under 35 U.S.C. § 120 to U.S. patent application Ser. No. 16/810,497, filed on Mar. 5, 2020, which claims priority to Japanese Patent Application No. 2019-041466, filed on Mar. 7, 2019, each of which are incorporated herein by reference in their entirety.

BACKGROUND

Field

Embodiments disclosed herein generally relate to a device and method for driving a self-luminous display panel.

Description of the Related Art

A display brightness level of a self-luminous display panel, such as an organic light emitting diode (OLED) display panel and a micro LED display panel, may be controlled by a ratio of the number of display elements that emit light to the total number of display elements of the self-luminous display panel. This ratio may be controlled by an emission pulse width. In one or more embodiments, the emission pulse width may be controlled to achieve a desired display brightness level.

SUMMARY

This summary is provided to introduce in a simplified form a selection of concepts that are further described below in the Detailed Description. This summary is not intended to identify key features or essential features of the claimed subject matter, nor is it intended to limit the scope of the claimed subject matter.

In one or more embodiments, a display driver is provided. The display driver comprises gamma processing circuitry, compensation circuitry, and driver circuitry. The gamma processing circuitry is configured to process image data to generate gamma processed image data. The compensation circuitry is configured to process the gamma-processed image data, based on a ratio of a number of display elements that emit light to a total number of display elements of a display panel, to generate compensated image data. The driver circuitry is configured to drive the display panel based on the compensated image data.

In other embodiments, a display driver comprises emission pulse generator circuitry and emission pulse width control circuitry. The emission pulse generator circuitry is configured to supply to a display panel an emission pulse that controls a ratio of a number of display elements that emit light to a total number of display elements of the display panel. The emission pulse width control circuitry is configured to control a pulse width of the emission pulse based on a brightness command value specifying a display brightness level of the display panel such that the pulse width monotonically and non-linearly increases with an increase in the brightness command value.

In one or more embodiments, a method for driving a display panel is provided. The method comprises processing image data to generate gamma-processed image data, and processing the gamma-processed image data, based on a ratio of a number of display elements that emit light to a total number of display elements of a display panel, to generate compensated image data. The method further comprises driving the display panel based on the compensated image data.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
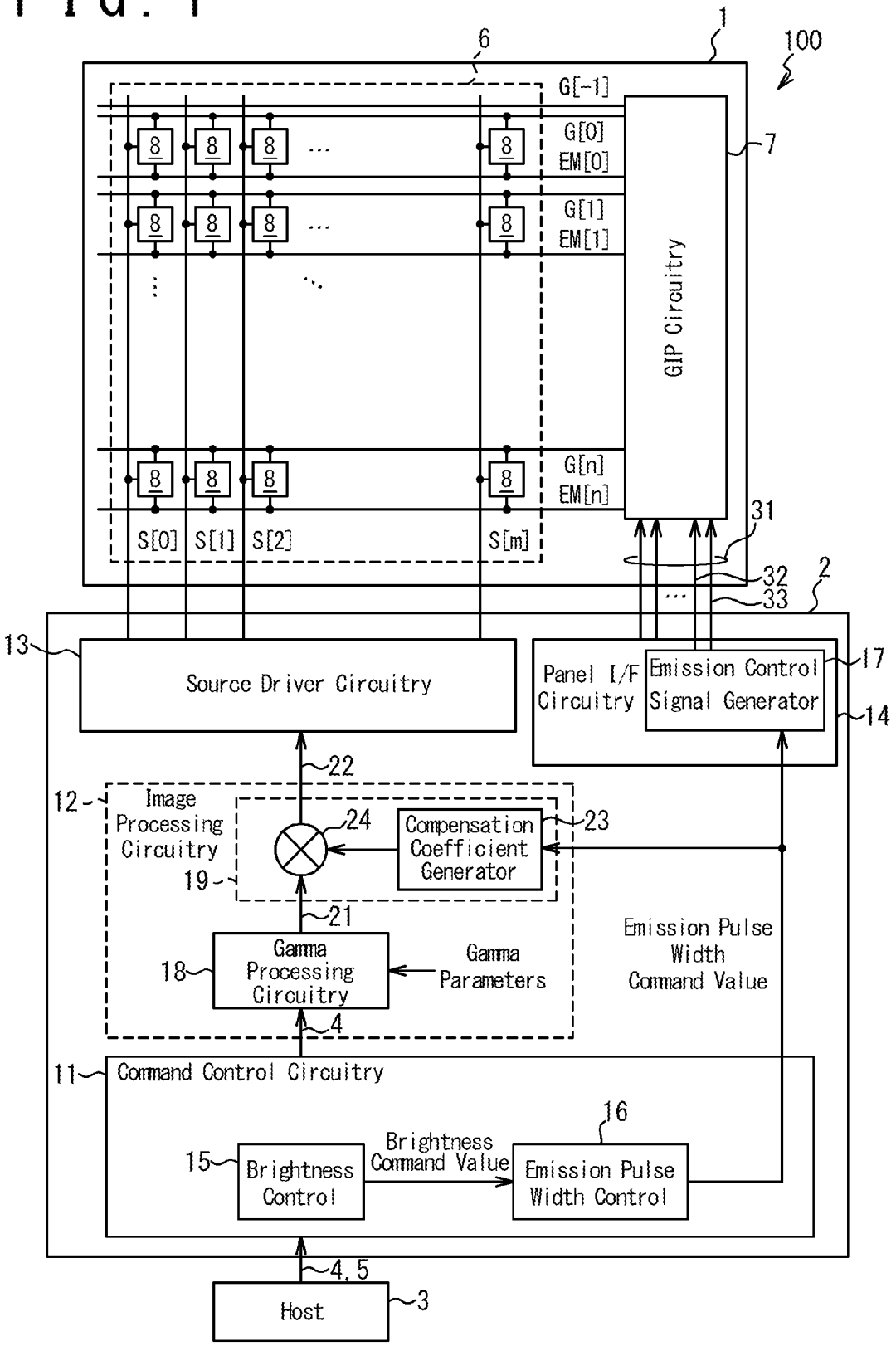
FIG. 1 illustrates an example configuration of a display device, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure.

Furthermore, there is no intention to be bound by any expressed or implied theory presented in the preceding background, summary, or the following detailed description.

The display brightness level of a self-luminous display panel depends on a ratio of the number of display elements that emit light to the total number of the display elements of the self-luminous display panel. This ratio may be controlled, for example, by an emission pulse width, which may be the width of an emission pulse supplied to the self-luminous display panel. The display brightness level may change non-linearly with the emission pulse width or the ratio of the number of the display elements that emit light to the total number of the display elements, and this may cause deterioration in the image quality. The change in the ratio of the number of display elements that emit light may also cause a change in gamma characteristics and/or chromaticity characteristics of a display device incorporating the self-luminous display panel. This may also cause deterioration in the image quality. In one or more embodiments described herein, compensation processing may be used to mitigate effects of a change in the ratio of display elements that emit light.

FIG. 1 illustrates an example configuration of a display device 100, according to one or more embodiment. In the embodiment illustrated, the display device 100 comprises a self-luminous display panel 1 and a display driver 2. The display device 100 may be configured to display an image on the self-luminous display panel 1 based on image data 4 and control data 5 received from a host 3. In one or more embodiments, an OLED display panel may be used as the self-luminous display panel 1.

In the embodiment illustrated, the self-luminous display panel 1 includes a display area 6 and a gate-in-panel (GIP) circuitry 7. In various embodiments, an image corresponding to the image data 4 is displayed in the display area 6. The display area 6 includes display elements 8, source lines S [0] to S [m], gate lines G [0] to G[n] and emission lines EM [0] to EM [n]. The gate lines G [0] to G [n] and emission lines EM [0] to EM [n] are connected to the GIP circuitry 7 and the source lines S [0] to S[m] are connected to the display driver 2. Each display element 8 may be connected to a corresponding gate line G [i], emission line EM [i], and source line S [j].

Figure 2:
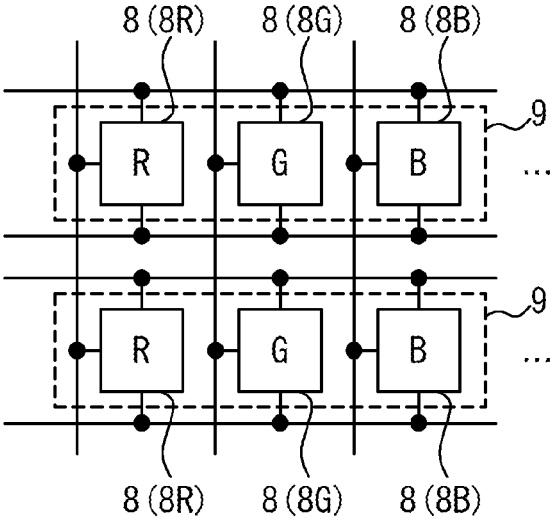
FIG. 2 illustrates an example configuration of a pixel, according to one or more embodiments.

In one or more embodiments, the display elements 8 arranged in the display area 6 comprises display elements 8 each configured to emit light of one of different three colors, for example, red (R), green (G), and blue (B). FIG. 2 illustrates an example configuration of a pixel 9 of the self-luminous display panel 1, according to one or more embodiments. Pixel 9 may comprise three display elements 8 configured to emit different colors. In various embodiments, each pixel 9 may comprise a display element 8 configured to emit red light, a display element 8 configured to emit green light, and a display element 8 configured to emit blue light. In FIG. 2, the display elements 8 configured to emit red, green, and blue are denoted by numerals 8R, 8G, and 8B, respectively. In the following description, a display element 8 configured to emit light of a certain color may be simply referred to as display element 8 of the color. For example, the display elements 8 configured to emit red, green, and blue may be referred to as red, green, and blue display elements 8. The display elements 8 arranged in the display area 6 may comprise display elements of a color other than red, green, and blue. In such embodiments, each pixel 9 may comprise a display element 8 of the color other than red, green, and blue. For example, each pixel 9 may further comprise a display element 8 configured to display white or yellow.

Referring back to FIG. 1, the image data 4 supplied to the display driver 2 may include grayscale values of the display elements 8 of the respective colors of each pixel 9. In embodiments where the image data 4 include grayscale values of the red, green, and blue display elements 8 of each pixel 9, the luminance levels of the red, green, and blue display elements 8 may be controlled by the grayscale values of red, green and blue.

In one or more embodiments, a drive voltage corresponding to a grayscale value of the image data 4 is written into each display element 8 via the corresponding source line S [j] from the display driver 2. Each display element 8 may be configured to emit light with a luminance level corresponding to the drive voltage written therein. Light emission of display elements 8 of each row may be controlled by the emission line EM [i] connected to the display elements 8 of each row. In various embodiments, the display elements 8 of each row may be configured to emit light when the emission line EM [i] connected thereto is asserted, and may stop emitting light when it is deasserted. Writing of drive voltages into the display elements 8 of each row may be controlled by the gate line G [i] connected thereto. In various embodiments, when a desired drive voltage is written into the display element 8 connected to the gate line G [i] and the source line S [j], the gate line G [i] is asserted in a state in which the desired drive voltage is generated on the source line S [j].

Figure 3:
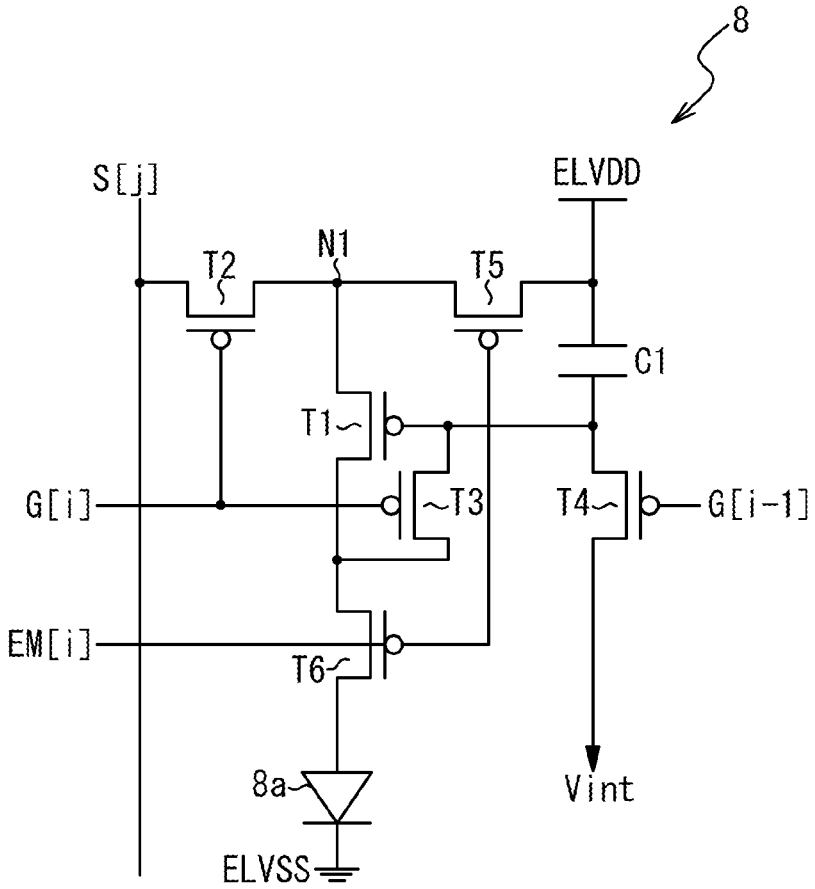
FIG. 3 illustrates an example configuration of a display element, according to one or more embodiments.

FIG. 3 illustrates an example configuration of the display element 8 connected to the gate line G [i], the emission line EM [i], and the source line S [j]. In the embodiment shown, the display element 8 comprises a drive transistor T1, a select transistor T2, a threshold compensation transistor T3, a reset transistor T4, select transistors T5, T6, a storage capacitor C1, and a light emitting element 8*a*. The transistors T1 to T6 may be configured as PMOS transistors. The transistors T1, T6, and the light emitting element 8*a* are connected in series between a node N1 and a low-side power source line that receives a low-side power source voltage ELVSS. The transistor T2 is connected between the node N1 and the source line S [j]. The gate of the transistor T2 is connected to the gate line G [i]. The transistor T3 is connected between the gate and drain of the transistor T1. The gate of the transistor T3 is connected to the gate line G [i]. The transistor T4 is connected between the gate of the transistor T4 and a node to which an initialization voltage Vint is supplied. The transistor T5 is connected between the node N1 and a high-side power source line that receive a high-side power source voltage ELVDD. The gate of the transistor T5 is connected to the emission line EM [i]. The transistor T6 is connected between the drain of the transistor T1 and the light emitting element 8*a*. The gate of the transistor T6 is connected to the emission line EM [i]. The storage capacitor C1 is connected between the gate of the transistor T1 and the high-side power source line. In various embodiments, an OLED element may be used as the light emitting element 8*a*. The display element 8 may be configured to store a storage voltage corresponding to a drive voltage across the storage capacitor C1 when the drive voltage is written into the display element 8. The gate-source voltage of the drive transistor T1 of the display element 8 may be maintained at a voltage corresponding to the storage voltage stored across the storage capacitor C1.

In one or more embodiments, when the emission line EM [i] is asserted, a drive current corresponding to the gate-source voltage of the drive transistor T1 is supplied to the light emitting element 8*a*, and the light emitting element 8*a* emits light with a luminance level corresponding to the drive current. In various embodiments, a reduction in the drive voltage written into the display element 8 increases the gate-source voltage of the drive transistor T1 and also increases the drive current. In such embodiments, the luminance level of the display element 8 may increase as the drive current increases, that is, as the drive voltage written into the display element 8 decreases.

The luminance level of the display element 8 may depend on the high-side power source voltage ELVDD supplied to the display element 8. In one or more embodiments, an increase in the high-side power source voltage ELVDD causes an increase in the storage voltage across the storage capacitor C1 for a constant drive voltage and thereby causes an increase in the drive current, and, as a result, increasing the luminance level of the display element 8.

The gate line G [i-1] may be used to precharge the capacitor C1 before the writing of the drive voltage. In such embodiments, a gate line G [−1] may be disposed in the self-luminous display panel 1 for precharging display elements 8 having the drive transistors T1 connected to the gate line G [0]. The configuration of the display elements 8 is not limited to that illustrated in FIG. 3, and various variations are possible. For example, the display elements 8 may be configured as a 5T2c circuit (including five thin film transistors (TFTs) and two capacitors) in other embodiments.

Referring back to FIG. 1, in one or more embodiments, the GIP circuitry 7 is configured to drive the gate lines G [−1] to G[n] and the emission lines EM [0] to EM [n] based on GIP control signals 31 received from the display driver 2. In the embodiment illustrated, the GIP control signals 31 comprise an emission pulse signal 32 and an emission clock signal 33. The emission pulse signal 32 controls a period during which display elements 8 of each row emit light. The emission pulse signal 32 may be repeatedly asserted and deasserted with a predetermined periodicity, and this may result in that emission pulses appear on the emission pulse signal 32. In such embodiments, the emission pulses may be used to control the emission lines EM [0] to EM[n].

Figure 4:
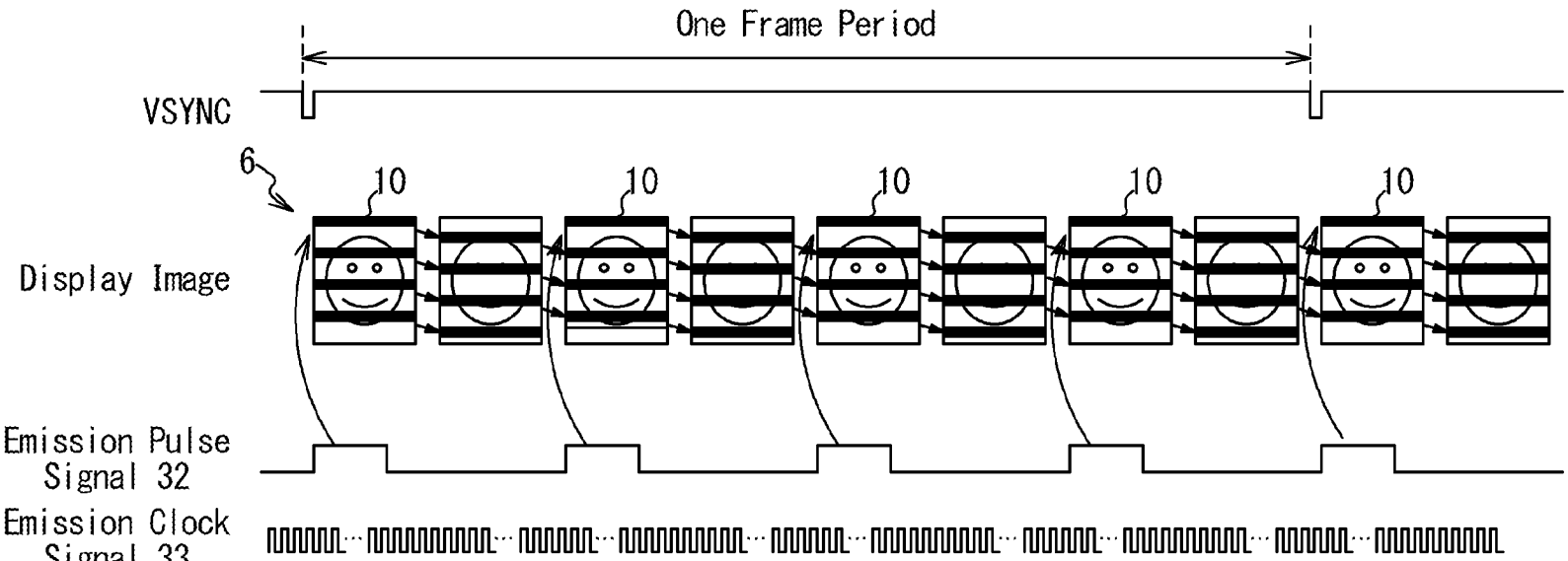
FIG. 4 illustrates an example control of light emission of display elements in respective rows by emission pulses, according to one or more embodiments.

FIG. 4 illustrates an example light emission control of display elements 8 by the GIP circuitry 7. In the embodiment illustrated, the GIP circuitry 7 is configured to control light emission of display elements 8 of each row in response to pulse widths of the emission pulses transmitted over the emission pulse signal 32. In the following, the pulse width of an emission pulse may be simply referred to as emission pulse width. The emission pulse width may be a time duration during which the emission pulse signal 32 is asserted in each periodicity. In embodiments where the emission pulse signal 32 is low-active, the emission pulse width may be a time duration during which the emission pulse signal 32 is set to the low level in each periodicity. In various embodiments, a plurality of emission pulses, four emission pulses in the operation illustrated in FIG. 4, appear on the emission pulse signal 32 per frame period.

In one or more embodiments, a non-light emitting area 10 in which display elements 8 do not emit light is inserted at an edge of the display area 6 (the top edge of the display area 6 in FIG. 4) based on the emission pulse signal 32. In various embodiments, the non-light emitting area 10 displays black. A non-light emitting area 10 may be inserted at the edge of the display area 6 while the emission pulse signal 32 is deasserted, for example, and set to the high level. In some embodiments, a predetermined number of emission lines EM located at the edge of the display area 6 are deasserted to insert a non-light emitting area 10 at the edge of the display area 6 while the emission pulse signal 32 is deasserted. In one or more embodiments, while the emission pulse signal 32 is asserted, for example, set to the low level, a non-light emitting area 10 is not inserted and display elements 8 of the row at the edge of the display area 6 emit light.

In various embodiments, the non-light emitting areas 10 successively move in synchronization with the emission clock signal 33 in the direction in which the source lines S [0] to S [m] are extended. In one or more embodiments, deasserted emission lines EM are shifted in synchronization with the emission clock signal 33 in the direction in which the source lines S [0] to S [m] are extended, and this moves the non-light emitting areas 10. The GIP circuitry 7 may comprise a shift register (not illustrated) that has outputs connected to the emission lines EM [0] to EM [n], respectively. In such embodiments, the shift register may be configured to perform a shift operation in synchronization with the emission clock signal 33, and the shifting of the deasserted emission lines EM may be achieved through the shift operation of the shift register.

In one or more embodiments, when a period during which the emission pulse signal 32 is deasserted is prolonged, a period during which a non-light emitting area 10 is inserted is also prolonged. This enlarges the width of the inserted non-light emitting area 10 in the direction in which the source lines S [0] to S [m] are extended. In various embodiments, when the widths of non-light emitting areas 10 are enlarged, the ratio of the area occupied by the non-light emitting areas 10 to the entire display area 6 increases, and this reduces the ratio of display elements 8 that emit light to the total number of the display elements 8 in the display area 6. When the widths of the non-light emitting areas 10 are reduced, the ratio of the area occupied by the non-light emitting areas 10 to the entire display area 6 decreases, and this increases the ratio of display elements 8 that emit light to all the display elements 8 in the display area 6.

In one or more embodiments, the display brightness level of the self-luminous display panel 1 is controlled by the ratio of the number of display elements 8 that emit light to the number of all of the display elements 8 disposed in the display area 6. The display brightness level may be the brightness level of the entire image displayed on the self-luminous display panel 1. In the embodiment illustrated, the widths of non-light emitting areas 10 are controlled by the emission pulse width to control the ratio of the number of display elements 8 that emit light to the total number of the display elements 8. In some embodiments, the display brightness level of the self-luminous display panel 1 becomes the lowest brightness level when the widths of the non-light emitting areas 10 are maximized by setting the emission pulse width to the minimum value. In some embodiments, the display brightness level of the self-luminous display panel 1 becomes the highest brightness level when the widths of the non-light emitting areas 10 are minimized by setting the emission pulse width to the maximum value.

Referring back to FIG. 1, the display driver 2 comprises command control circuitry 11, image processing circuitry 12, source driver circuitry 13, and panel interface circuitry 14, in one or more embodiments.

The command control circuitry 11 may be configured to forward the image data 4 received from the host 3 to the image processing circuitry 12 and control the entire operation of the display driver 2 based on the control data 5. In other embodiments, the command control circuitry 11 may be configured to process the image data 4 and send the processed image data to the image processing circuitry 12. In embodiments where the control data 5 comprise a command (or an instruction), the operation of the display driver 2 may be controlled by the command.

The command control circuitry 11 may comprise brightness control circuitry 15 and emission pulse width control circuitry 16. The brightness control circuitry 15 may be configured to generate a brightness command value that specifies the display brightness level of the self-luminous display panel 1 based on the control data 5. The display brightness level may be controlled by appropriately generating the brightness command value. In some embodiments, the control data 5 comprises a brightness level setting command to set the display brightness level, and the brightness control circuitry 15 is configured to generate the brightness command value based on a display brightness value (DBV) specified by the brightness level setting command. In such embodiments, the display brightness level may be controlled by the DBV. In one or more embodiments, the emission pulse width control circuitry 16 is configured to determine an emission pulse width based on the brightness command value received from the brightness control circuitry 15 and send an emission pulse width command value indicative of the determined emission pulse width to the panel interface circuitry 14. In some embodiments, the emission pulse width is determined to increase proportionally to the brightness command value. The emission pulse width command value may indicate the duty ratio of the emission pulse signal 32. In such embodiments, the duty ratio of the emission pulse signal 32 may increase proportionally to the brightness command value.

In one or more embodiments, the image processing circuitry 12 is configured to apply desired image processing to the image data 4 received from the command control circuitry 11, and the processed image data generated through this image processing are supplied to the source driver circuitry 13.

In one or more embodiments, the source driver circuitry 13 is configured to write drive voltages into the respective display elements 8 of the self-luminous display panel 1 based on the processed image data received from the image processing circuitry 12. The source driver circuitry 13 may be configured to generate the drive voltages through analog-digital conversion of the processed image data received from the image processing circuitry 12 and write the drive voltages thus generated into the associated display elements 8.

In one or more embodiments, the panel interface circuitry 14 is configured to generate the GIP control signals 31 supplied to the GIP circuitry 7 of the self-luminous display panel 1. The panel interface circuitry 14 may comprise emission control signal generator circuitry 17 configured to generate the above-described emission pulse signal 32 and emission clock signal 33. In various embodiments, the emission control signal generator circuitry 17 is configured to generate the emission pulse signal 32 based on the emission pulse width command value received from the command control circuitry 11. The emission control signal generator circuitry 17 may be configured to control pulse widths of the emission pulses on the emission pulse signal 32 in response to the emission pulse width command value.

In the embodiment illustrated, the image processing circuitry 12 comprises gamma processing circuitry 18 and compensation circuitry 19.

Figure 5:
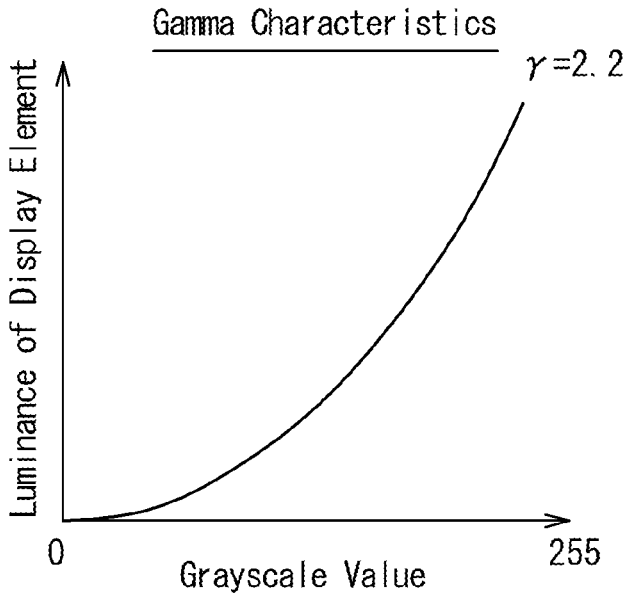
FIG. 5 illustrates example gamma characteristics, according to one or more embodiments.

The gamma processing circuitry 18 is configured to apply gamma processing to the image data 4 to generate gamma-processed image data 21. The gamma-processed image data 21 may be generated to achieve desired gamma characteristics. FIG. 5 illustrates example gamma characteristics. The gamma characteristics may represent a correlation between grayscale values of display elements 8 included in the image data 4 and luminance levels of the display elements 8. The gamma characteristics may be expressed by a gamma value y. The gamma-processed image data 21 may be generated to achieve gamma characteristics of a desired gamma value y. The gamma-processed image data 21 may be generated so that the luminance level of the display element 8 is proportional to a y-th power of a grayscale value of the gamma-processed image data 21 for a display element 8 when a drive voltage corresponding to the grayscale value is written into the display element 8 based on the gamma-processed image data 21. The gamma value may be 2.2, for example. The gamma processing may be based on gamma parameters supplied to the gamma processing circuitry 18. The gamma parameters are set to achieve desired gamma characteristics, for example, gamma characteristics of a desired gamma value y.

Figure 6:
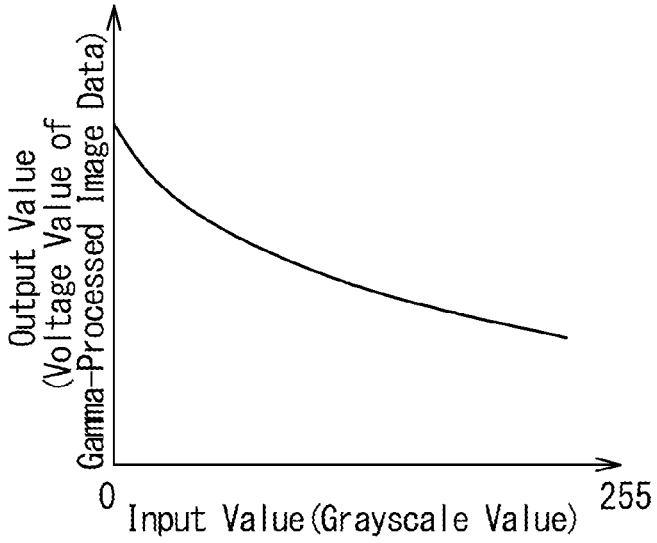
FIG. 6 illustrates an example input-output curve of gamma processing circuitry, according to one or more embodiments.

In one or more embodiments, a value of the gamma-processed image data 21 associated with a display element 8 is generated to specify a voltage value of the drive voltage to be written into the display element 8. In such embodiments, an input value of the gamma processing circuitry 18 may be a grayscale value of the image data 4 and an output value of the gamma processing circuitry 18 may be a voltage value of the gamma-processed image data 21. FIG. 6 illustrates an example correlation between the input and output values of the gamma processing circuitry 18. In embodiments where each display element 8 is configured as illustrated in FIG. 3 so that the luminance level of the display element 8 increases as the drive voltage decreases, the voltage value of the gamma-processed image data 21 associated with the display element 8 may be generated by the gamma processing to decrease as the grayscale value of the associated display element 8 increases. Such gamma processing may be achieved by designing an input-output curve of the gamma processing circuitry 18 so that the output value decreases as the input value increases. In one or more embodiments, the gamma parameters may be determined to define such input-output curve.

In one or more embodiments, the compensation circuitry 19 is configured to generate compensated image data 22 by applying compensation processing to the gamma-processed image data 21 based on the ratio of the number of display elements 8 that emit light to the total number of the display elements 8. In embodiments where the ratio of the number of the display elements 8 that emit light to the total number of the display elements 8 is controlled by the emission pulse width, the compensation circuitry 19 may be configured to apply the compensation processing to the gamma-processed image data 21 based on the emission pulse width. In embodiments where the gamma-processed image data 21 include voltage values of drive voltages to be written into the display elements 8, the compensation circuitry 19 may be configured to perform the compensation processing so that the compensated image data 22 include compensated voltage values.

Figure 7:
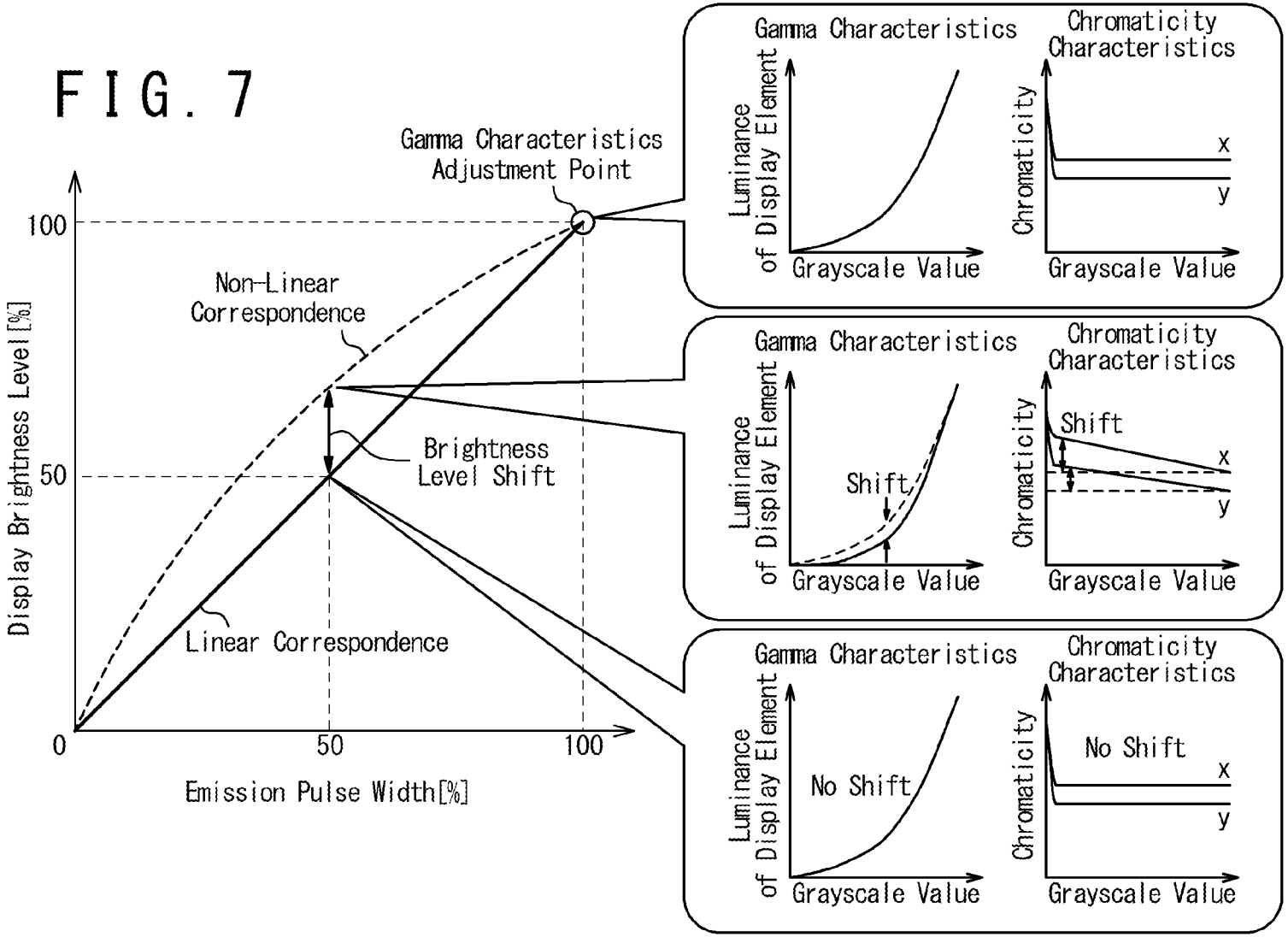
FIG. 7 illustrates example display characteristics of a display device, according to one or more embodiments.

FIG. 7 illustrates an example control of the display brightness level by the emission pulse width. In embodiments where the emission pulse width is determined to increase proportionally to the brightness command value, the display brightness level of the self-luminous display panel 1 may vary non-linearly or linearly with the emission pulse width. The non-linearly of the display brightness level may result from a voltage drop over power source lines that deliver the high-side power source voltage ELVDD to the respective display elements 8. A change in the emission pulse width may cause a change in the ratio of the number of display elements 8 that emit light to the total number of the display elements 8 and cause a change in the total sum of the drive currents flowing through the display elements 8. This may cause a voltage change on the power source lines that deliver the high-side power source voltage ELVDD to the respective display elements 8. In one or more embodiments, the compensation circuitry 19 is configured to compensate the non-linearity of the display brightness level against the emission pulse width or the ratio of the number of the display elements 8 that emit light to the total number of the display elements 8. The compensation circuitry 19 may be configured to perform the compensation processing to cause the display brightness level to change linearly with the emission pulse width or the ratio of the number of the display elements 8 that emit light to the total number of the display elements 8.

In one or more embodiments, the gamma parameters supplied to gamma processing circuitry 18 are adjusted to achieve desired gamma characteristics for a predetermined emission pulse width, for example, the maximum emission pulse width. In FIG. 7, the emission pulse width used to generate the gamma parameters is indicated by "Gamma Characteristics Adjustment Point." In one or more embodiments, the gamma parameters adjusted for the "Gamma Characteristics Adjustment Point" are used for any emission pulse widths. In such embodiments, as illustrated in FIG. 7 for example, the gamma characteristics may vary depending on the emission pulse width due to the dependency of the luminance levels of the display elements 8 on the emission pulse width. In one or more embodiments, the compensation circuitry 19 is configured to compensate variations in the gamma characteristics which may result from changes in the emission pulse width or changes in the ratio of the number of display elements 8 that emit light to the total number of the display elements 8. The compensation circuitry 19 may be configured to perform the compensation processing to reduce or eliminate the dependency of the gamma characteristics on the emission pulse width.

A change in the emission pulse width may cause a change in the chromaticity characteristics. The change in the chromaticity characteristics may result from a change in the ratio of the area occupied by the non-light emitting areas 10 to the display area 6. Since the non-light emitting areas 10 display black, effects of the chromaticity of black displayed in the non-light emitting areas 10 increase as the ratio of the area occupied by the non-light emitting areas 10 increases in response to the emission pulse width. In FIG. 7, the chromaticity characteristics for the case where the grayscale values of red, green, and blue of a pixel 9 is the same (that is, the case where the pixel 9 displays white) are illustrated as the dependencies of the chromaticity coordinates x, y of the pixel 9 that displays white. The compensation circuitry 19 may be configured to perform the compensation processing to reduce or eliminate the variations in the chromaticity characteristics depending on the emission pulse width.

In one or more embodiments, the source driver circuitry 13 is configured to receive the compensated image data 22 generated through the compensation processing and write drive voltages into the respective display elements 8 based on the compensated image data 22. In embodiments where the compensated image data 22 are generated to include compensated voltage values of the drive voltages to be written into the respective display elements 8, the source driver circuitry 13 may be configured to generate the drive voltages based on the compensated voltage values of the compensated image data 22. The source driver circuitry 13 may be configured to write drive voltages proportional to the voltage values of the compensated image data 22 into the corresponding display elements 8.

Referring back to FIG. 1, the compensation circuitry 19 may comprise compensation coefficient generator circuitry 23 and compensation processing circuitry 24. The compensation coefficient generator circuitry 23 may be configured to generate compensation coefficients used for the compensation processing. The compensation processing circuitry 24 may be configured to generate the compensated image data 22 by processing the gamma-processed image data 21 based on the compensation coefficients received from the compensation coefficient generator circuitry 23. The compensation processing circuitry 24 may be configured to generate the compensated image data 22 by multiplying the voltage values of the gamma-processed image data 21 by the compensation coefficients generated by the compensation coefficient generator circuitry 23. The compensated image data 22 may be generated so that the compensated voltage values of the compensated image data 22 are the products of the compensation coefficients and the voltage values of the gamma-processed image data 21.

Figure 8:
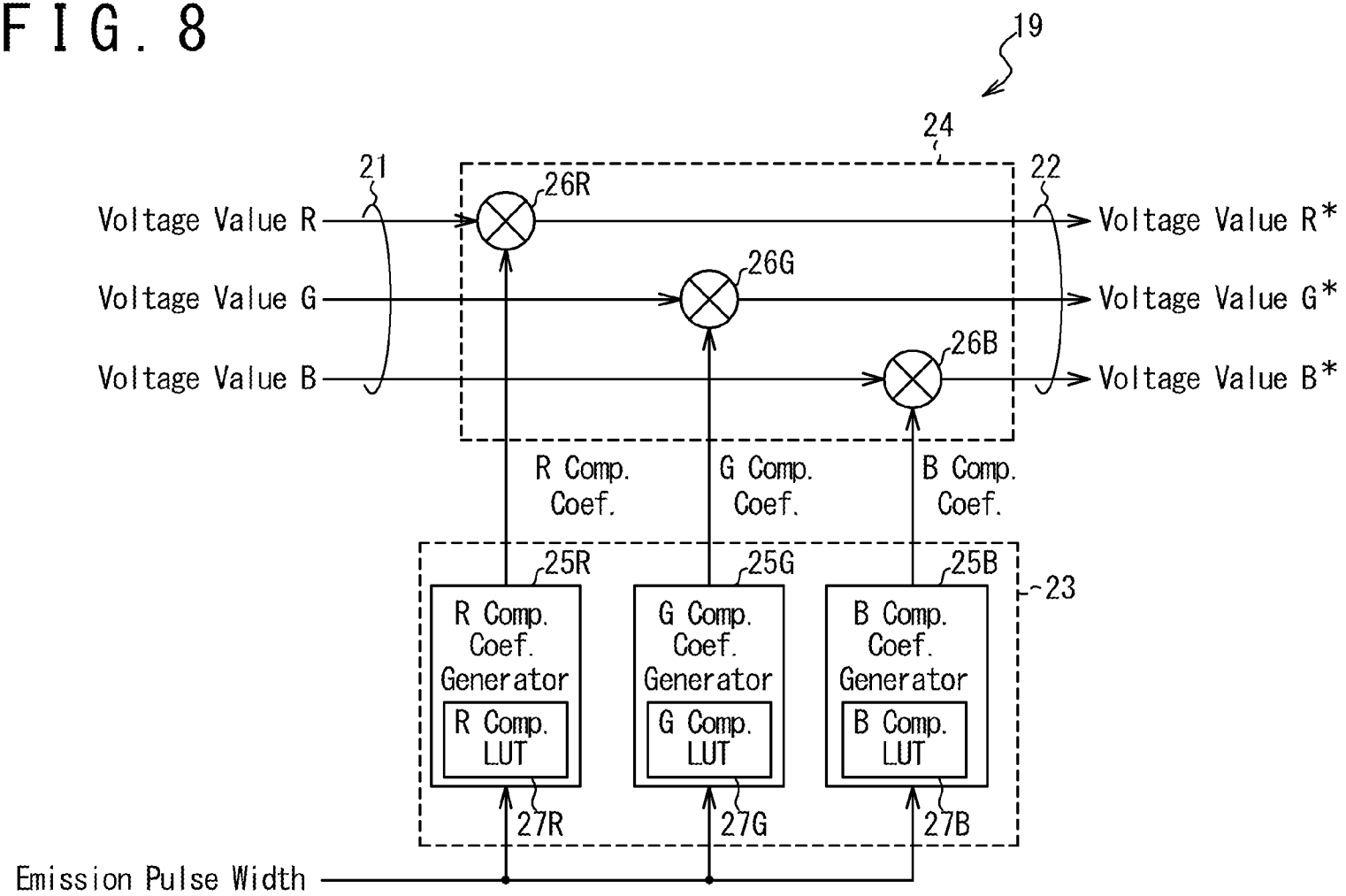
FIG. 8 illustrates an example configuration of compensation circuitry, according to one or more embodiments.

FIG. 8 illustrates example configurations of the compensation coefficient generator circuitry 23 and the compensation processing circuitry 24. In the embodiment illustrated, the compensation coefficient generator circuitry 23 and the compensation processing circuitry 24 are configured to perform the compensation processing for the respective colors of the display elements 8. For example, the compensation coefficient generator circuitry 23 and the compensation processing circuitry 24 may be configured to individually perform the compensation processing for red, green, and blue to compensate variations in the chromaticity characteristics.

In the embodiment illustrated, the compensation coefficient generator circuitry 23 comprises an R compensation coefficient generator 25R, a G compensation coefficient generator 25G, and a B compensation coefficient generator 25B, and the compensation processing circuitry 24 comprises an R processing unit 26R, a G processing unit 26G, and a B processing unit 26B. The gamma-processed image data 21 may include, for each pixel 9, a voltage value R associated with the display element 8 of red, a voltage value G associated with the display element 8 of green, and a voltage value B associated with the display element 8 of blue. The compensated image data 22 may include, for each pixel 9, a voltage value R* associated with the display element 8 of red, a voltage value G* associated with the display element 8 of green, and a voltage value B* associated with the display element 8 of blue.

The R compensation coefficient generator 25R is configured to generate an R compensation coefficient based on the emission pulse width and supplies the R compensation coefficient to the R processing unit 26R. The R processing unit 26R is configured to generate the voltage value R* of the compensated image data 22 by processing the voltage value R of the gamma-processed image data 21 based on the R compensation coefficient. The R processing unit 26R may be configured as a multiplier that calculates the voltage value R* by multiplying the voltage value R by the R compensation coefficient.

The G compensation coefficient generator 25G is configured to generate a G compensation coefficient based on the emission pulse width and supplies the G compensation coefficient to the G processing unit 26G. The G processing unit 26G is configured to generate the voltage value G* of the compensated image data 22 by processing the voltage value G of the gamma-processed image data 21 based on the G compensation coefficient. The G processing unit 26G may be configured as a multiplier that calculates the voltage value G* by multiplying the voltage value G by the G compensation coefficient.

The B compensation coefficient generator 25B is configured to generate a B compensation coefficient based on the emission pulse width and supplies the B compensation coefficient to the B processing unit 26B. The B processing unit 26B is configured to generate the voltage value B* of the compensated image data 22 by processing the voltage value B of the gamma-processed image data 21 based on the B compensation coefficient. The B processing unit 26B may be configured as a multiplier that calculates the voltage value B* by multiplying the voltage value B by the B compensation coefficient.

The R compensation coefficient generator 25R may be configured to store R correlation data that indicate the correlation of the emission pulse width with the R compensation coefficient and use the R correlation data for the generation of the R compensation coefficient based on the emission pulse width. The R correlation data may be stored in the R compensation coefficient generator 25R in the form of an R compensation lookup table (LUT) 27R. The R compensation coefficient generator 25R may be configured to generate the R compensation coefficient through table lookup on the R compensation LUT 27R with reference to the emission pulse width.

The G compensation coefficient generator 25G may be configured to store G correlation data that indicate the correlation of the emission pulse width with the G compensation coefficient and use the G correlation data for the generation of the G compensation coefficient based on the emission pulse width. The G correlation data may be stored in the G compensation coefficient generator 25G in the form of a G compensation LUT 27G. The G compensation coefficient generator 25G may be configured to generate the G compensation coefficient through table lookup on the G compensation LUT 27G with reference to the emission pulse width.

The B compensation coefficient generator 25B may be configured to store B correlation data that indicate the correlation of the emission pulse width with the B compensation coefficient and use the B correlation data for the generation of the B compensation coefficient based on the emission pulse width. The B correlation data may be stored in the B compensation coefficient generator 25B in the form of a B compensation LUT 27B. The B compensation coefficient generator 25B may be configured to generate the B compensation coefficient through table lookup on the B compensation LUT 27B with reference to the emission pulse width.

In one or more embodiments, the R correlation data, the G correlation data and the B correlation data stored in the R compensation LUT 27R, the G compensation LUT 27G, and the B compensation LUT 27B, respectively, are generated in a shipping test of the display device 100. In embodiments where display characteristics are tested in the shipping test of the display device 100, the R correlation data, the G correlation data and the B correlation data may be generated based on the test results so that desired compensation processing may be performed in the compensation circuitry 19.

Figure 9:
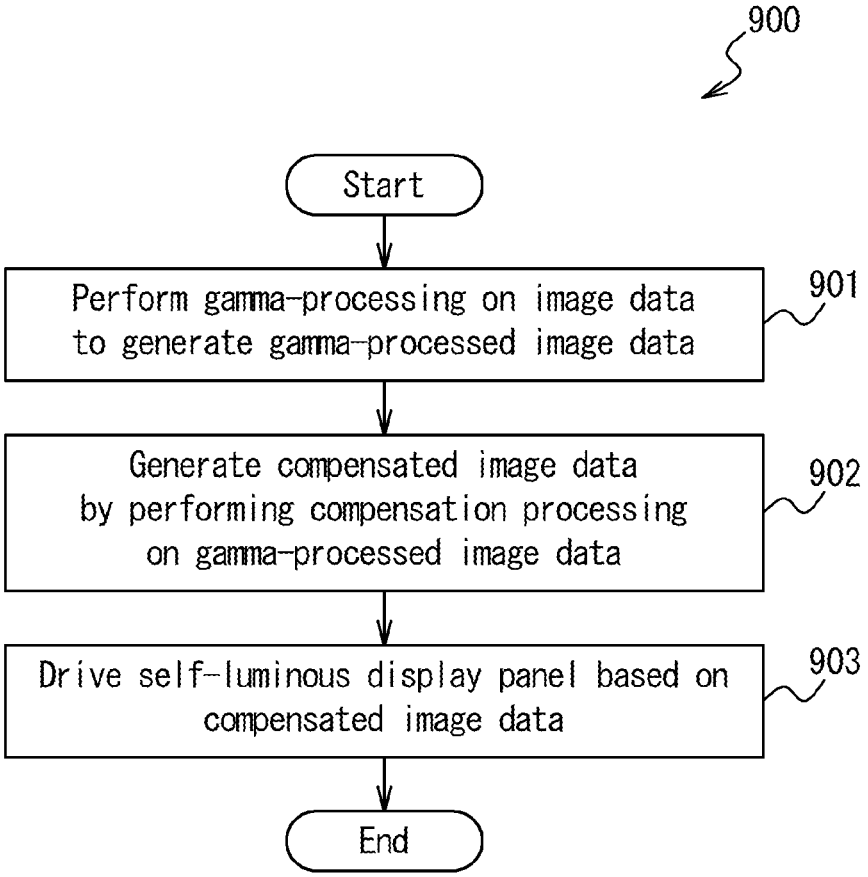
FIG. 9 illustrates an example method for driving a self-luminous display panel, according to one or more embodiments.

Method 900 illustrated in FIG. 9 illustrates steps for driving the self-luminous display panel 1, in one or more embodiments. It is here noted that in other examples the order of the steps may be altered from the order illustrated, and there may be a greater, or a fewer, number of steps.

In the embodiment illustrated, in step 901, the gamma processing circuitry 18 (as shown, for example, in FIG. 1) applies gamma-processing to the image data 4 to generate the gamma-processed image data 21.

In step 902, the compensation circuitry 19 generates the compensated image data 22 (as shown, for example, in FIG. 1) by applying compensation processing to the gamma-processed image data 21 based on a ratio of the number of display elements 8 that emit light in a frame period to the total number of display elements 8 of the self-luminous display panel 1. In embodiments where the ratio of the number of the display elements 8 that emit light is controlled by the emission pulse width, the compensation processing may be based on the emission pulse width. For example, the compensation processing may be performed such that the display brightness level changes linearly with the emission pulse width. The compensation processing may be performed to compensate for a change in the gamma characteristics and/or the chromaticity characteristics caused by a change in the emission pulse width.

In step 903, the source driver circuitry 13 drives the self-luminous display panel 1 based on the compensated image data 22.

Figure 10:
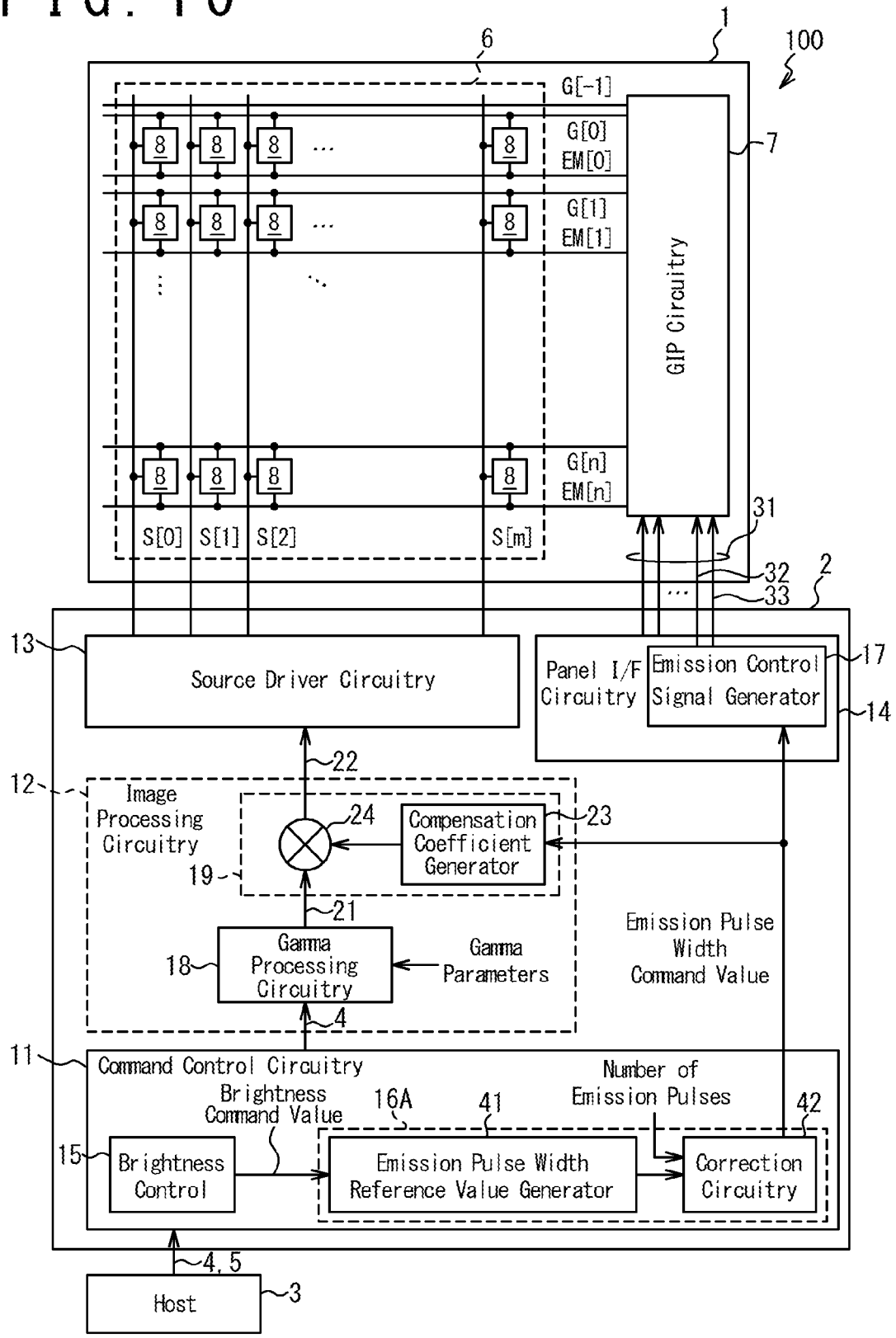
FIG. 10 illustrates an example configuration of a display device, according to one or more embodiments.

FIG. 10 illustrates an example configuration of the display driver 2 in other embodiments. In the embodiment illustrated, the command control circuitry 11 comprises an emission pulse width control circuitry 16A configured to determine an emission pulse width suitable for achieving a display brightness level proportional to the brightness command value.

Figure 11:
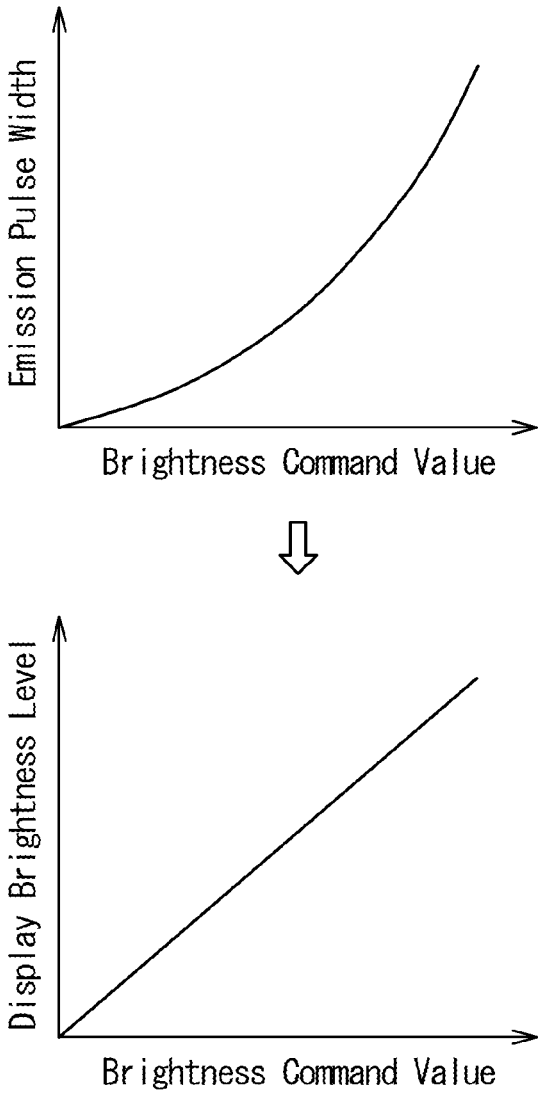
FIG. 11 illustrates an example correlation among a brightness command value, an emission pulse width, and a display brightness level, according to one or more embodiments.

To compensate the above-described non-linearity of the display brightness level against the emission pulse width, in one or more embodiments, the emission pulse width control circuitry 16A is configured to determine the emission pulse width so that the emission pulse width monotonically increases non-linearly with an increase in the brightness command value. FIG. 11 illustrates an example correlation of the emission pulse width with the emission command value. In one or more embodiments, the emission pulse width control circuitry 16A is configured to control the emission pulse width change rate based at least in part on the display brightness command value. In one or more embodiments, the emission pulse width control circuitry 16A may be configured to determine the emission pulse width so that the rate of change of the emission pulse width increases with an increase in the brightness command value. In such embodiments, the emission pulse width control circuitry 16A may be configured to determine the emission pulse width so that the rate of increase of the emission pulse width with an increase in the brightness command value increases as the brightness command value increases. In such embodiments, the curve representing a correlation of the emission pulse width against the brightness command value is convex downward. Generating emission pulses of the emission pulse width thus determined enables controlling the display brightness level to increase linearly or proportionally with the brightness command value.

Referring back to FIG. 10, in one or more embodiments, the emission pulse width control circuitry 16A may be configured to generate and supply an emission pulse width command value indicative of the thus-determined emission pulse width to the emission control signal generator circuitry 17. The emission pulse width command value may be generated to specify the duty ratio of emission pulses, and the emission pulse width may be controlled based on the specified duty ratio by the emission control signal generator circuitry 17.

The display brightness level may change when the number of emission pulses per frame period changes while the duty ratio of the emission pulses remains unchanged. To reduce the dependency of the display brightness level on the number of emission pulses per frame period, in one or more embodiments, the emission pulse width control circuitry 16A is configured to generate the emission pulse width command value, which specifies the duty ratio of emission pulses, based on the brightness command value and the number of emission pulses per frame period.

In the embodiment illustrated in FIG. 10, the emission pulse width control circuitry 16A comprises an emission pulse width reference value generator 41 and correction circuitry 42. In one or more embodiments, the emission pulse width reference value generator 41 is configured to generate an emission pulse width reference value that specifies a duty ratio of emission pulses based on the brightness command value received from the brightness control circuitry 15. The emission pulse width reference value generator 41 may be configured to generate the emission pulse width reference value to increase linearly with the brightness command value.

In one or more embodiments, the correction circuitry 42 is configured to generate the emission pulse width command value supplied to the emission control signal generator circuitry 17 by correcting the emission pulse width reference value. The correction circuitry 42 may be configured to generate the emission pulse width command value by correcting the emission pulse width reference value based on the number of emission pulses per frame period. This may reduce or eliminate the dependency of the display brightness level on the number of emission pulses per frame period.

In embodiments where the emission pulse width command value is generated so that the display brightness level changes linearly with the brightness command value, the compensation circuitry 19 may be configured to withhold the compensation processing in relation to the non-linearity of the display brightness level against the emission pulse width. Such configuration may facilitate the design of the compensation processing to be performed by the compensation circuitry 19. In one implementation, the emission pulse width control circuitry 16A is configured to generate the emission pulse width command value so that the display brightness level changes linearly with the brightness command value, while the compensation circuitry 19 is configured to compensate changes in the gamma characteristics and/or the chromaticity characteristics caused by changes in the emission pulse width.

In other embodiments, the operation of the compensation circuitry 19 is stopped and the gamma-processed image data 21 may be supplied to the source driver circuitry 13 without modification. Also in such embodiments, the emission pulse width command value may be generated so that the display brightness level changes linearly with the brightness command value.

Figure 12:
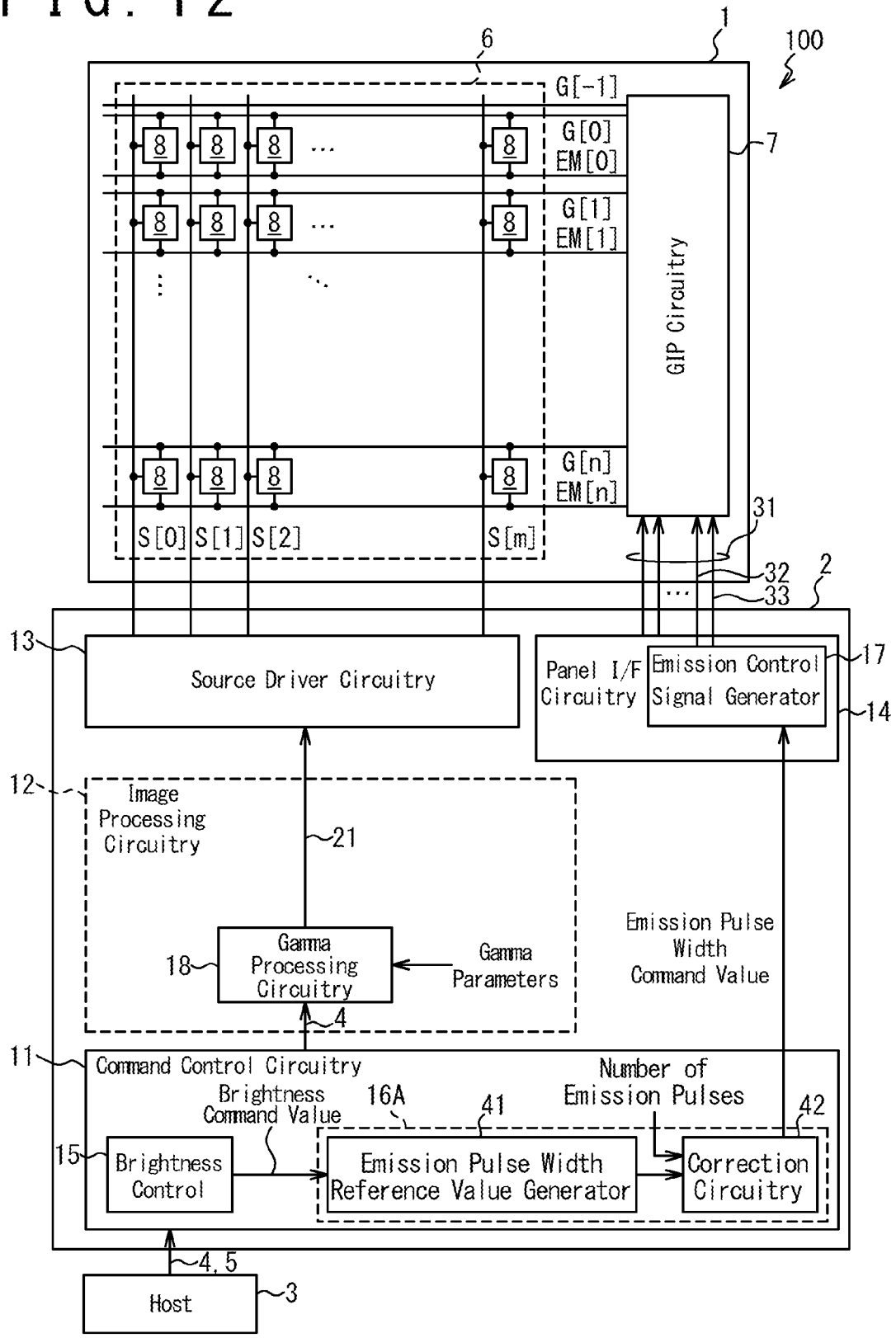
FIG. 12 illustrates an example configuration of a display device, according to one or more embodiments.

FIG. 12 illustrates an example configuration of the display driver 2 in other embodiments. In the embodiment illustrated, the command control circuitry 11 comprises the above-described emission pulse width control circuitry 16A while the compensation circuitry 19 is removed from the image processing circuitry 12. This configuration also enables generating the emission pulse width command value so that the display brightness level changes linearly with the brightness command value.

Figure 13:
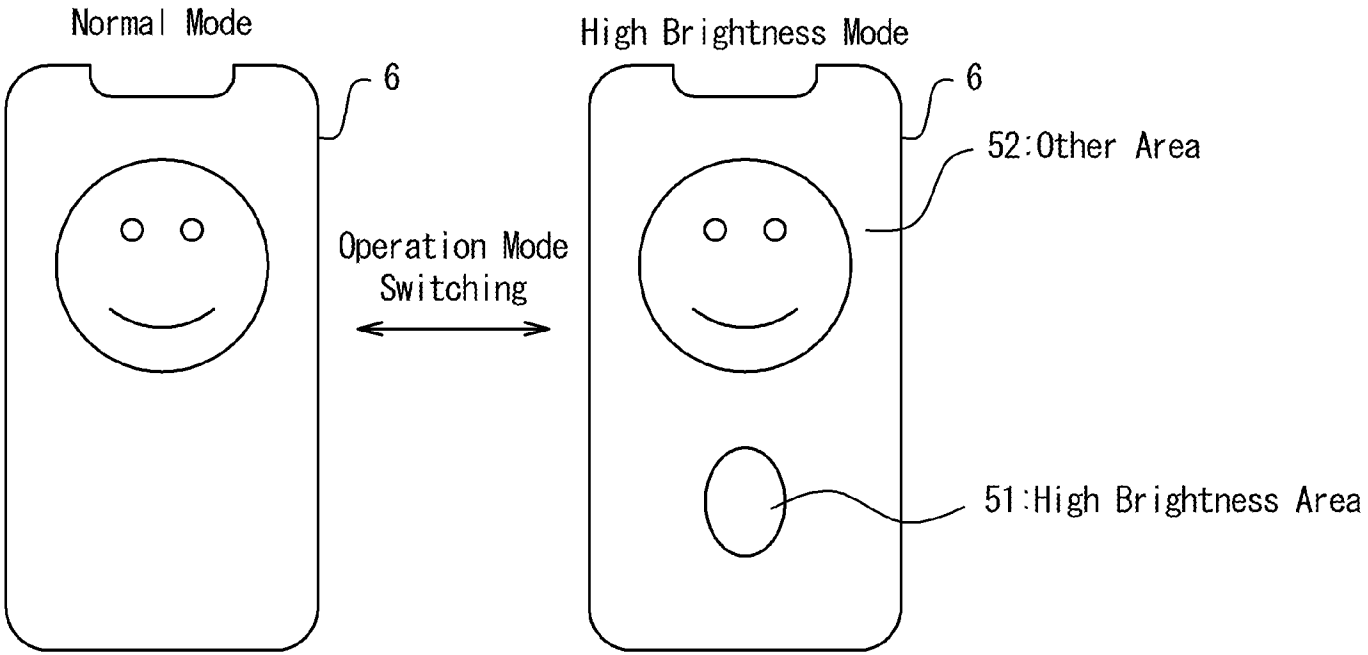
FIG. 13 illustrates example operation modes of a display device, according to one or more embodiments.

FIG. 13 illustrates example operation modes of the display device 100. In the embodiment illustrated, the display device 100 has a normal mode and a high brightness mode. In one or more embodiments, a high brightness area 51 is disposed in the display area 6 when the display device 100 is placed in the high brightness mode. In one implementation, drive voltages written into display elements located in the high brightness area 51 are generated in the high brightness mode so that these display elements emit light with a high luminance level, for example, the highest luminance level. The image data associated with the display elements in the high brightness area 51 may be set to the highest grayscale value to control the display elements in the high brightness area 51 to emit light with the highest luminance level.

In one or more embodiments, the display device 100 may be placed in the high brightness mode to dispose the high brightness area 51 when optical in-display fingerprint recognition is performed on the display area 6. In such embodiments, the high brightness area 51 may be disposed in a fingerprint recognition area on which a finger is to be placed in the in-display fingerprint recognition. Disposing the high brightness area 51 may intensify the light with which the finger is illuminated and improve the accuracy of the optical fingerprint recognition. In one or more embodiments, a normal image display may be performed in the area other than the high brightness area 51. The display device 100 may be placed in the normal mode when the in-display fingerprint recognition is not performed. In the normal mode, the high brightness area 51 is not disposed and the normal image display may be performed in the entire display area 6.

Figure 14:
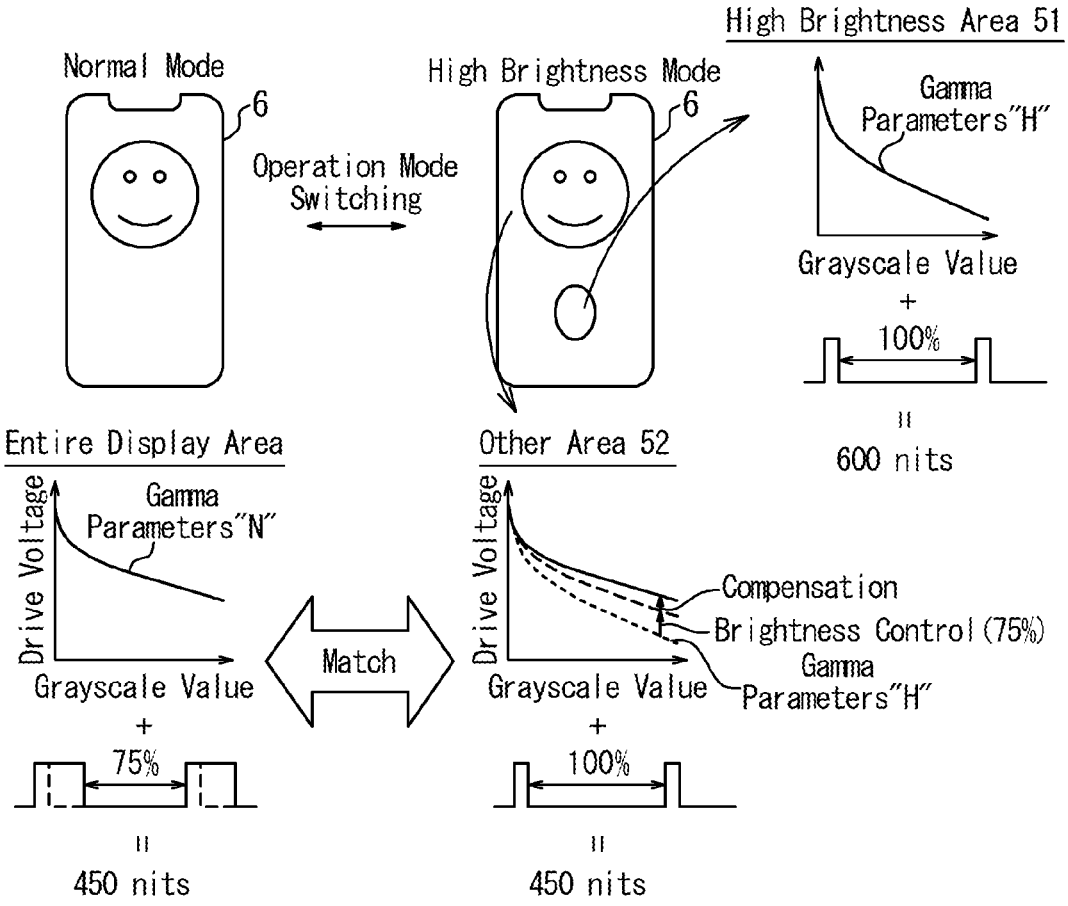
FIG. 14 illustrates example operations of a display device in each of a normal mode and a high brightness mode.

FIG. 14 illustrates example operations in the normal mode and the high brightness mode of the display device 100 (as shown in FIG. 1). In the illustrated embodiment of FIG. 14, the emission pulse width is increased to increase the brightness in the high brightness area 51 when the display device 100 is placed in the high brightness mode. The emission pulse width may be set to the allowed maximum pulse width in the high brightness mode. In FIG. 14, the allowed maximum pulse width is indicated by "100%."

In one or more embodiments, the settings of the gamma processing circuitry 18 (as shown in FIG. 1), including the gamma parameters supplied to the gamma processing circuitry 18, are adjusted to maintain the brightness level of the other area 52 (e.g., other than the high brightness area 51) when the display device 100 is placed in the high brightness mode to increase the emission pulse width. The gamma parameters may be adjusted depending on the operation mode of the display device 100 and the positions of the display elements for which the gamma-processed image data are to be calculated.

In one or more embodiments, when the display device 100 is placed in the normal mode, gamma parameters "N" may be selected and supplied to the gamma processing circuitry 18, and the emission pulse width may be set to 75% of the maximum pulse width. In one implementation, the maximum brightness level of the display area 6 is set to, for example, 450 nits through this operation.

In one or more embodiments, when the display device 100 is placed in the high brightness mode, gamma parameters "H" may be selected and supplied to the gamma processing circuitry 18, and the emission pulse width may be set to 100% of the maximum pulse width. In one implementation, the gamma parameters "H" are used for the gamma processing on the image data associated with the display elements in the high brightness area 51, and the maximum brightness level of the display area 6 is thereby set to, for example, 600 nits, a shown. As regards gamma processing on the image data that is associated with display elements in the other area 52, in one or more embodiments, the gamma parameters may be calculated from the gamma parameters "H" in the gamma processing circuitry 18 so that the luminance levels of the display elements are reduced to 75% of those achieved by gamma parameters "H", and the gamma processing may be performed using the thus-calculated gamma parameters. In FIG. 14, the calculation of such gamma parameters is indicated by the legend "Brightness Control (75%)" on the bottom right plot of the figure (labelled "Other Area 52"). Such gamma parameter calculation may reduce the changes in the brightness level in the other area 52 when the operation mode of the display device 100 is switched between the normal mode and the high brightness mode.

In one or more embodiments, changes in the gamma characteristics and/or the chromaticity characteristics may be compensated for by compensation circuitry 19 (as shown in FIG. 1) when the emission pulse width is increased in the high brightness mode. Changes in the gamma characteristics and/or the chromaticity characteristics may result from changes in the emission pulse width. In one or more embodiments, compensation of the changes in the gamma characteristics and/or the chromaticity characteristics may suppress the changes in the display characteristics in the other area 52 or maintain the display characteristics in the other area 52. This may suppress flicker noise that potentially occurs when the display device 100 is switched between the normal mode and the high brightness mode. In one implementation, the highest brightness level in the other area 52 is controlled to be 450 nits, which is identical to that of the normal mode.

While various embodiments have been specifically described herein, a person skilled in the art would appreciate that the technologies disclosed herein may be implemented with various modifications.

What is claimed is:

1. A display driver comprising:

a compensation coefficient generator circuitry configured to generate a compensation coefficient based on a width of an emission pulse;

compensation processing circuitry configured to:

compensate for a change in chromaticity characteristics of a display panel caused by a change of the width of the emission pulse, and generate compensated image data by processing image data using the compensation coefficient and a ratio of a number of display elements that emit light to a total number of display elements of the display panel, the ratio based on the width of the emission pulse; and driver circuitry configured to drive the display panel based on the compensated image data.

2. The display driver of claim 1, further comprising:

gamma processing circuitry configured to gamma-process the image data prior to the processing of the image data by the compensation processing circuitry.

3. The display driver of claim 2, wherein the gamma processing circuitry is configured to gamma-process the image data based on a gamma parameter determined based on desired gamma characteristics; and wherein the compensation processing circuitry is configured to compensate for a change of gamma characteristics from the desired gamma characteristics caused by a change of the width of the emission pulse.

4. The display driver of claim 1, further comprising:

emission pulse generator circuitry configured to supply the emission pulse.

5. The display driver of claim 1, wherein the compensation processing circuitry is further configured to cause a display brightness level of the display panel to change linearly with the width of the emission pulse.

6. The display driver of claim 1, wherein the compensation processing circuitry is further configured to perform compensation processing for respective colors of the display elements of the display panel.

7. The display driver of claim 1, further comprising:

emission pulse width control circuitry configured to control the width of the emission pulse based on a brightness command value that specifies a display brightness level of the display panel.

8. The display driver of claim 7, wherein the emission pulse width control circuitry is configured to control the width of the emission pulse so that the width of the emission pulse monotonically and non-linearly increases with an increase in the brightness command value.

9. The display driver of claim 7, wherein the emission pulse width control circuitry is configured to control a change rate of the emission pulse based at least in part on the brightness command value.

10. The display driver of claim 9, wherein the change rate of the emission pulse increases with an increase in the brightness command value.

11. A display driver comprising:

a compensation coefficient generator circuitry configured to generate a compensation coefficient based on a width of an emission pulse;

emission pulse width control circuitry configured to:

control the width of the emission pulse based on a brightness command value that specifies a display brightness level of a display panel, and control a duty ratio of the emission pulse based on: a number of emission pulses per frame period and the brightness command value;

compensation processing circuitry configured to generate compensated image data by processing image data using the compensation coefficient and a ratio of a number of display elements that emit light to a total number of display elements of the display panel, the ratio based on the width of the emission pulse; and driver circuitry configured to drive the display panel based on the compensated image data.

12. A method comprising:

generating a compensation coefficient based on a width of an emission pulse;

generating compensated image data by processing image data using the compensation coefficient and a ratio of a number of display elements that emit light to a total number of display elements of a display panel, the ratio based on the width of the emission pulse, wherein generating the compensated image data comprises compensating for a change in chromaticity characteristics of the display panel caused by a change in the width of the emission pulse; and driving the display panel based on the compensated image data.

13. The method of claim 12, further comprising:

causing a display brightness level of the display panel to change linearly with the width of the emission pulse.

14. The method of claim 12, further comprising:

gamma-processing the image data prior to generating the compensated image data.

15. The method of claim 14, wherein gamma-processing the image data is performed based on a gamma parameter determined based on desired gamma characteristics; and wherein generating the compensated image data comprises compensating for a change in gamma characteristics from the desired gamma characteristics caused by a change of the width of the emission pulse.

16. The method of claim 12, further comprising:

controlling the width of the emission pulse based on a brightness command value that specifies a display brightness level of the display panel, wherein the width of the emission pulse monotonically and non-linearly increases with an increase in the brightness command value.

17. A display device comprising:

a display panel; and a display driver comprising:

a compensation coefficient generator circuitry configured to generate a compensation coefficient based on a width of an emission pulse;

compensation processing circuitry configured to:

compensate for a change in chromaticity characteristics of the display panel caused by a change of the width of the emission pulse, and generate compensated image data by processing image data using the compensation coefficient and a ratio of a number of display elements that emit light to a total number of display elements of the display panel, the ratio based on the width of the emission pulse; and driver circuitry configured to drive the display panel based on the compensated image data.

18. The display device of claim 17, wherein the display driver further comprises:

emission pulse width control circuitry configured to control the width of the emission pulse based on a brightness command value that specifies a display brightness level of the display panel.

* * * * *